US007014721B2

(12) United States Patent
Shiga et al.

(10) Patent No.: US 7,014,721 B2
(45) Date of Patent: Mar. 21, 2006

(54) IRON-NICKEL ALLOY MATERIAL FOR SHADOW MASK WITH EXCELLENT SUITABILITY FOR ETCHING

(75) Inventors: Natsuki Shiga, Kanagawa (JP); Hidekazu Todoroki, Kanagawa (JP)

(73) Assignee: Nippon Yakin Kogyo Co., Ltd., Tokyo (JP)

( * ) Notice: Subject to any disclaimer, the term of this patent is extended or adjusted under 35 U.S.C. 154(b) by 151 days.

(21) Appl. No.: 10/399,549

(22) PCT Filed: Nov. 20, 2001

(86) PCT No.: PCT/JP01/10140

§ 371 (c)(1),
(2), (4) Date: Apr. 23, 2003

(87) PCT Pub. No.: WO02/42508

PCT Pub. Date: May 30, 2002

(65) Prior Publication Data

US 2004/0037732 A1 Feb. 26, 2004

(51) Int. Cl.
*C22C 38/40* (2006.01)

(52) U.S. Cl. ..... 148/336; 420/94

(58) Field of Classification Search ..... 148/336; 420/94

See application file for complete search history.

(56) References Cited

U.S. PATENT DOCUMENTS

| | | | |
|---|---|---|---|
| 5,127,965 A | | 7/1992 | Inoue et al. |
| 5,234,512 A | * | 8/1993 | Inoue et al. ..... 148/541 |
| 5,391,241 A | | 2/1995 | Watanabe et al. |

FOREIGN PATENT DOCUMENTS

| | | | |
|---|---|---|---|
| FR | 2733767 | | 11/1996 |
| JP | 61-84356 | | 4/1986 |
| JP | 62-161936 | | 7/1987 |
| JP | 1-247558 | | 10/1989 |
| JP | 4-99152 | | 3/1992 |
| JP | 6-41687 | | 2/1994 |
| JP | 7-179998 | | 7/1995 |
| JP | 7-243004 | | 9/1995 |
| JP | 7-268558 | | 10/1995 |
| JP | 10-259454 | | 9/1998 |
| JP | 411315354 | * | 11/1999 |
| JP | 2000265250 | * | 9/2000 |
| JP | 2001-303201 | | 10/2001 |
| JP | 2002-4006 | | 1/2002 |

OTHER PUBLICATIONS

English Language Abstract of JP 62-161936.
English Language Abstract of JP 10-259454.
English Language Abstract of FR 2 733 767.
English Language Abstract of JP 7-243004.

(Continued)

*Primary Examiner*—Deborah Yee
(74) *Attorney, Agent, or Firm*—Greenblum & Bernstein, P.L.C.

(57) ABSTRACT

The invention is a Fe—Ni alloy material comprising Ni: 26–37 wt %, Si: 0.001–0.2 wt %, Mn: 0.01–0.6 wt %, Al: 0.0001–0.003 wt %, Mg: not more than 0.001 wt %, Ca: not more than 0.001 wt % and the reminder being Fe and inevitable impurities, and containing not more than 0.02 wt % of one or more $MnO—SiO_2—Al_2O_3$ inclusion, $SiO_2$ inclusion and $MgO—Al_2O_3$ inclusion insoluble in an aqueous solution of ferric chloride, and is to provide electronic materials for shadow mask and the like having a good hole shape in an etching treatment and a high quality.

20 Claims, 1 Drawing Sheet

OTHER PUBLICATIONS

English Language Abstract of JP 2001-303201.
English Language Abstract of JP 2002-4006.
English Language Abstract of JP 7-179998.
English Language Abstract of JP 6-41687.
English Language Abstract of JP 4-99152.
English Language Abstract of JP 7-268558.
English Language Abstract of JP 61-84356.
English Language Abstract of JP 1-247558.

* cited by examiner

IRON-NICKEL ALLOY MATERIAL FOR SHADOW MASK WITH EXCELLENT SUITABILITY FOR ETCHING

TECHNICAL FIELD

This invention relates to a Fe—Ni alloy material for shadow masks having an excellent etching workability, and particularly provides a Fe—Ni alloy material containing a non-metallic inclusion(s) insoluble in an aqueous solution of ferric chloride.

BACKGROUND ART

Heretofore, the Fe—Ni alloy materials have been used as various functional materials including a magnetic material, a lead frame and a shadow mask. These materials are worked to a product thickness of about 0.1–1 mm in accordance with applications. Particularly, Fe-36 wt % Ni alloy is low in the thermal expansion coefficient and is useful as a shadow mask material. This shadow mask material is usually produced subjecting a Fe—Ni alloy sheet to an etching treatment using an aqueous solution of ferric chloride.

As to the etching workability of the shadow mask material, there are many inventions in view of surface properties (JP-A-4-99152 and so on), plane orientation (JP-A-1-247558 and so on) and the like. Also, study examples focusing attention to non-metallic inclusions contained in the alloy are disclosed in JP-A-61-84356 and JP-A-7-268558, but all of them aim only at the reduction of the non-metallic inclusion amount. However, even if the non-metallic inclusion amount is reduced, there may be a case that the deterioration of hole shape accompanied with the poor etching work is caused depending upon the kind and composition of the non-metallic inclusions.

That is, when holes are formed by the etching treatment using the aqueous solution of ferric chloride at the production step of the shadow mask, if non-metallic inclusions are existent in positions to be pierced and the etching is carried out, the shape of the holes in the shadow mask material is poor. Especially, if the non-metallic inclusions are soluble in the etching solution, the hole shape is further poor. Particularly, if the non-metallic inclusion is mainly composed of MgO or CaO, as shown in FIG. 1, the non-metallic inclusions existing on the surface of the thin sheet are dissolved in the etching solution and corrode Fe—Ni alloy thereabout to cause a problem that the shape of the etched hole is deteriorated.

It is, therefore, an object of the invention to develop a technique capable of solving the above problems of the conventional technique and to provide a Fe—Ni alloy material for shadow mask having an excellent etching workability.

DISCLOSURE OF THE INVENTION

The inventors have made various studies with respect to the formation of non-metallic inclusion not causing the poor shape of the etched hole for solving the above problems. That is, Fe-36 wt % Ni alloy is first melted in a laboratory, and then $CaO—SiO_2—Al_2O_3—MgO—F$ based slag is added to the alloy melt, and thereafter deoxidized with a deoxidizing agent such as Si, Mn, Al, Mg, Ca or the like to prepare a steel ingot. This steel ingot is forged or hot rolled and then cold rolled to a product thickness of 0.11 mm. Thereafter, it is etched with an aqueous solution of ferric chloride (45 Baume, temperature 60° C.), and corrosion state through inclusions around the etched hole portions is examined.

As a result, the inventors have found that when the non-metallic inclusion in the Fe—Ni alloy material has a composition of at least one or more of $MnO—SiO_2—Al_2O_3$, $SiO_2$ and $MgO—Al_2O_3$ spinel, the poor shape of the etched hole can be prevented and hence the Fe—Ni alloy having an excellent etching workability can be obtained.

Further, it has been confirmed that when a sum of CaO and MgO in the $MnO—SiO_2—Al_2O_3$ based inclusion exceeds 30 wt %, these oxides are dissolved in the etching solution to proceed corrosion and to cause poor hole shape.

The invention is based on the above findings. That is, the invention provides a Fe—Ni-alloy material having an alloy composition characterized by comprising Ni: 26–37wt %, Si: 0.001–0.2wt %, Mn: 0.01–0.6 wt %, Al: 0.0001–0.003 wt %, Mg: not more than 0.001 wt %, Ca: not more than 0.001 wt %, Nb: 0.01–1.0 wt % and Co: 1–8 wt % and the remainder being Fe and inevitable impurities, and containing at least two inevitable non-metallic inclusions selected from $MnO—SiO_2—Al_2O_3$ based inclusion having a composition of MnO: 25–50 wt %, $SiO_2$: 40–60 wt % and $Al_2O_3$: 5–30 wt %, $MgO—Al_2O_3$ spinel having a composition of MgO: 5–45 wt % and $Al_2O_3$: 55–95 wt % and $SiO_2$. Also, it is preferable that a sum of CaO and MgO as an oxide component included in the $MnO—SiO_2—Al_2O_3$ based inclusion of this material is not more than 30 wt %.

BEST MODE FOR CARRYING OUT THE INVENTION

Figure 1:
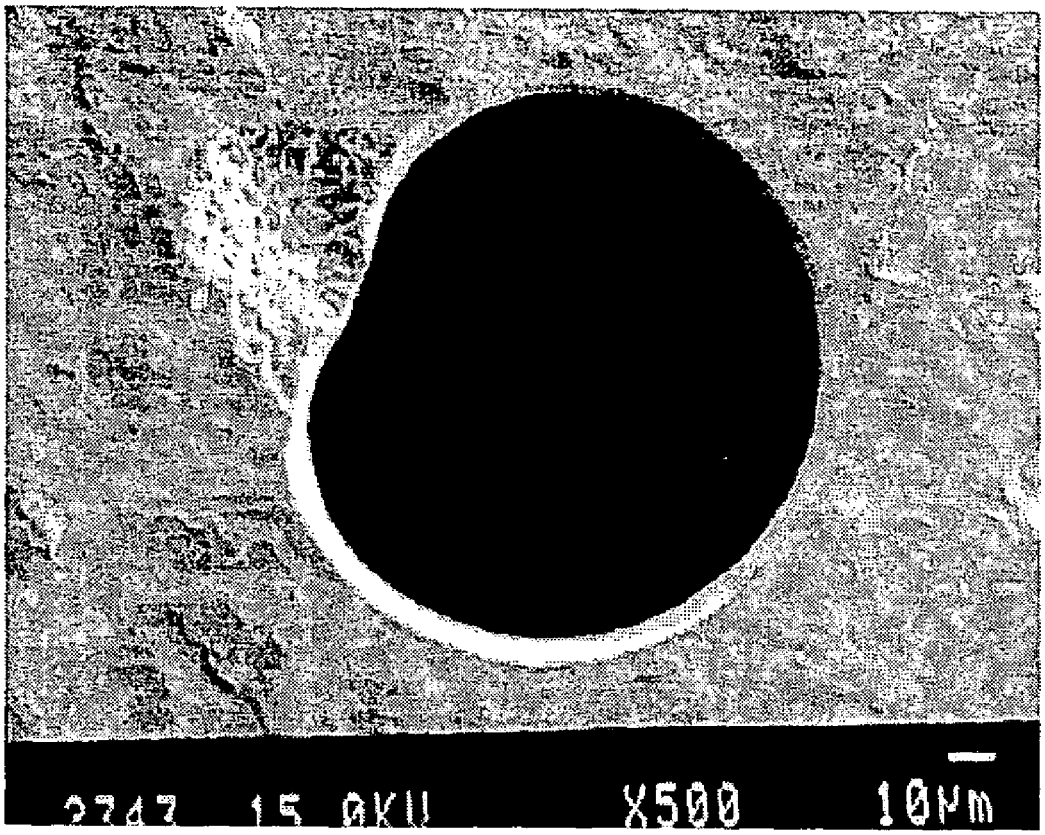
FIG. 1 is a microphotograph illustrating a shape of an etched hole resulting from inclusions.

The reasons the chemical components and composition of the alloy material according to the invention are limited to the above are described together with the action of Fe—Ni alloy. Ni: 26–37 wt %

Ni is an element that affects the thermal expansion, and it is known that the thermal expansion coefficient at 200° C. reaches a minimum at around 36 wt % of Ni when no Co is present. Also, when Co is present and the sum of the Co and Ni contents is in a range of 35–38 wt %, the thermal expansion coefficient becomes small. Therefore, the Ni content is defined to be 26–37 wt %.

Si: 0.001–0.2 wt %

Si is an element required for not only the deoxidation of molten steel but also the control of inclusion composition to $MnO—SiO_2—Al_2O_3$ system or $SiO_2$. When the Si amount is less than 0.001 wt %, the inclusion composition can not be controlled to $MnO—SiO_2—Al_2O_3$ system or $SiO_2$ and it is difficult to ensure the necessary etching workability. While, when it exceeds 0.2 wt %, the thermal expansion coefficient becomes large and the required characteristics are not satisfied. In the invention, therefore, the Si amount is limited to 0.001–0.2 wt %. A preferable range is 0.01–0.1 wt %.

Mn: 0.01–0.6 wt %

Mn is an element useful for controlling the inclusion composition to $MnO—SiO_2—Al_2O_3$ system. However, it is an element that increases the thermal expansion coefficient. From this viewpoint, it is desirable to keep the Mn concentration as low as possible. That is, when the Mn amount is less than 0.01 wt %, the inclusion composition can not be controlled to $MnO—SiO_2—Al_2O_3$ system, while when it exceeds 0.6 wt %, the thermal expansion coefficient is too large and the required characteristics are not satisfied. Therefore, the Mn amount is limited to 0.01–0.6 wt %. A preferable range is 0.03–0.4 wt %.

Al: 0.0001–0.003 wt %

Al is an element effective for controlling the inclusion composition to $MnO—SiO_2—Al_2O_3$ system or $MgO—Al_2O_3$ system having an excellent corrosion resistance. However, as the concentration of Al becomes high, the inclusion composition affords alumina, which tends to easily form clusters, and the surface properties are deteriorated and the required quality is not satisfied. In the invention, therefore, the Al amount is limited to 0.0001–0.003 wt %. A preferable range is 0.0002–0.002 wt %.

Mg: not more than 0.001 wt %

Mg is a useful element from a viewpoint that the inclusion composition is controlled to $MgO—Al_2O_3$, but when it exceeds 0.001 wt %, the main body of the inclusion is MgO alone, which adversely affects the etching workability. Even if Mg is not present, the inclusion composition is rendered into $MnO—SiO_2—Al_2O_3$ system having an excellent etching workability, so that the Mg amount is limited to not more than 0.001 wt %. It is preferably not more than 0.0009 wt %.

Ca: not more than 0.001 wt %

Ca is such an element that when it exceeds 0.001 wt %, the concentration of CaO in the inclusion rises and badly affects the etching workability. Therefore, it is desirable to reduce the addition of Ca as far as possible. From this point, Ca is limited to not more than 0.001 wt %. Preferably, it is not more than 0.0009 wt %.

Nb: 0.01–1.0 wt %

Nb has an effect of lowering the thermal expansion coefficient when it is present in a small amount, and is an effective element. However, when the Nb content exceeds 1.0 wt %, the thermal expansion coefficient increases. Therefore, when Nb is added, its concentration is 0.01–1.0 wt %. Preferably, its concentration is in a range of 0.02–0.5 wt %.

Co: 1–8 wt %

Co is an element that affects the thermal expansion coefficient. In case of Fe—Ni alloy containing Co, when the Co amount is outside a range of 1–8 wt %, the thermal expansion coefficient becomes large, which is not suitable for shadow mask production. Therefore, the Co amount is limited to 1–8 wt %.

In order to obtain the expected effects in the Fe—Ni alloy material according to the invention, it is concluded that it is necessary to control the composition of the non-metallic inclusion in form of oxides included in such Fe—Ni alloy matrix.

As the form of the non-metallic inclusion required in the invention, the main component has a form of one or more of $MnO—SiO_2—Al_2O_3$ system, $SiO_2$, and $MgO—Al_2O_3$.

Particularly, it has been found that the composition of the $MnO—SiO_2—Al_2O_3$ based inclusion is good within ranges of MnO: 25–50 wt %, $SiO_2$: 40–60 wt % and $Al_2O_3$: 5–30 wt %. When the composition is in the above range, the inclusion is vitrified and hardly causes a dissolution in the etching solution. However, when MnO exceeds 50 wt %, the phenomenon of dissolving in the etching solution is confirmed though it is not at the same level as with CaO, MgO.

Similarly, the other two of $MgO—Al_2O_3$ and $SiO_2$ are insoluble in the aqueous solution of ferric chloride, so that they do not cause the poor hole shape.

From various experiments made by the inventors, it has been confirmed that when CaO or MgO is incorporated into the $MnO—SiO_2—Al_2O_3$ based inclusion, the corrosion considerably proceeds in the etching solution. Particularly, it is observed that when more than 30 wt % in total of CaO and MgO are incorporated into the $MnO—SiO_2—Al_2O_3$ based inclusion, the corrosion is conspicuous and the shape of the etched hole tends to be disordered. In the invention, therefore, the sum of CaO and MgO is 30 wt % as an upper limit. Preferably, it is suppressed to about 5 wt %, or further it is preferable not to contain them.

EXAMPLE

In an electric furnace is melted Fe—Ni alloy and the resulting molten alloy is subjected to a deoxidation treatment by adding $CaO—SiO_2—Al_2O_3—MgO—F$ based slag in AOD or VOD. The molten alloy after the treatment is cast through a continuous casting machine to prepare a slab. Thereafter, the slab is hot rolled and then cold rolled to a product thickness of 0.11 mm. A test piece of 200 mm×400 mm is cut out from the thus obtained cold rolled sheet and pierced by etching in an aqueous solution of ferric chloride (45 Baum, temperature 60° C.) to examine corrosion state around the hole through inclusion, i.e. poor hole shape.

The evaluation method is as follows.

① Chemical components: The test piece cut out from the slab is analyzed by a fluorescent X-ray analyzing apparatus.

② Inclusion composition: A quantitative analysis on inclusions is randomly carried out on 20 points by using EDS (energy dispersion type analyzing apparatus).

③ Poor hole shape: 100 etched holes are randomly observed by an electron microscope to count the number of poor hole shapes.

In Table 1 are shown the contents of the examples and evaluation results thereof. In the invention examples, all of the inclusion compositions have concentrations of MnO, $SiO_2$ and $Al_2O_3$ within proper ranges and are controlled to a silicate having a sum of MgO and CaO of not more than 30 wt % or silica or spinel, and the poor hole shape due to the etching is not caused.

On the other hand, comparative examples are described below. In No. 10, the concentrations of Mg and Ca are high and the sum of MgO and CaO in the silicate based inclusion exceeds 30 wt % and hence the poor hole shape is confirmed. In No. 11, the Si amount is below the lower limit and the inclusion is a silicate mainly composed of MnO and hence the poor hole shape is confirmed. In No. 12, Mg is high and the inclusion is MgO only and hence the poor hole shape is caused. In No. 13, Ca is high and the inclusion is a silicate mainly composed of CaO and hence the poor hole shape is caused. In No. 14, the amount of Si largely exceeds the upper limit and there is no problem in the inclusion composition, but the thermal expansion coefficient exceeds the required level to result in a reject product. In No. 15, Al and Mg are high and the inclusion is spinel system, magnesia and alumina. As a result, not only the poor hole shape but also the poor surface quality due to alumina clusters are simultaneously confirmed. In No. 16, the amount of Mn is below the lower limit and the silicate based inclusion is outside the proper range and the sum of MgO and CaO exceeds 30%, and hence the poor hole shape is caused.

TABLE 1

| | | Chemical components (wt %) | | | | | | | | Inclusion composition (wt%) | | | | | | | | Analysis on 20 points by EDS | | | | | | | | | Evaluation of etching Poor hole shape (holes/100 holes) |
|---|---|---|---|---|---|---|---|---|---|---|---|---|---|---|---|---|---|---|---|---|---|---|---|---|---|---|---|
| | | | | | | | | | | Silicate base | | | | | | Silica | | Spinel base | | | Niobium oxide | | Magnesia | | Alumina | | |
| | | Ni | Si | Mn | Al | Mg | Ca | Nb | Co | n | MnO | $SiO_2$ | $Al_2O_3$ | MgO | CaO | n | $SiO_2$ | n | MgO | $Al_2O_3$ | n | $Nb_2O_5$ | n | MgO | n | $Al_2O_3$ | |
| Invention Example | 1 | 31.98 | 0.022 | 0.31 | 0.0003 | 0.0001 | 0.0004 | — | 5.03 | 18 | 31.4 | 44.3 | 12.4 | 4.1 | 7.8 | 0 | | 2 | 6.5 | 93.5 | 0 | | 0 | | 0 | | 0 |
| | 2 | 36.00 | 0.015 | 0.25 | 0.0005 | 0.0004 | 0.0005 | — | — | 12 | 25.2 | 40.2 | 24.1 | 9.2 | 1.3 | 0 | | 8 | 25.4 | 74.6 | 0 | | 0 | | 0 | | 0 |
| | 3 | 35.98 | 0.121 | 0.42 | 0.0015 | 0.0005 | 0.0002 | — | — | 10 | 27.1 | 41.2 | 28.1 | 3.2 | 0.4 | 2 | 100 | 8 | 36.1 | 63.9 | 0 | | 0 | | 0 | | 0 |
| | 4 | 36.03 | 0.033 | 0.27 | 0.0002 | 0.0001 | 0.0002 | 0.16 | — | 20 | 48.1 | 45.2 | 5.5 | 0.3 | 0.9 | 0 | | 0 | | | 0 | | 0 | | 0 | | 0 |
| | 5 | 35.06 | 0.162 | 0.52 | 0.0023 | 0.0009 | 0.0007 | — | — | 0 | | | | | | 0 | | 20 | 43.2 | 56.8 | 0 | | 0 | | 0 | | 0 |
| | 6 | 36.01 | 0.042 | 0.03 | 0.0018 | 0.0002 | 0.0004 | 0.18 | — | 0 | | | | | | 6 | 100 | 12 | 41.9 | 58.1 | 2 | 100 | 0 | | 0 | | 0 |
| | 7 | 35.99 | 0.039 | 0.02 | 0.0020 | 0.0002 | 0.0005 | 0.16 | — | 0 | | | | | | 8 | 100 | 12 | 29.1 | 70.9 | 0 | | 0 | | 0 | | 0 |
| | 8 | 36.00 | 0.003 | 0.02 | 0.0003 | 0.0003 | 0.0004 | — | — | 8 | 25.3 | 40.2 | 9.5 | 15.2 | 9.8 | 12 | 100 | 0 | | | 0 | | 0 | | 0 | | 0 |
| | 9 | 36.04 | 0.026 | 0.29 | 0.0001 | 0.0001 | 0.0001 | — | — | 17 | 26.2 | 58.1 | 10.5 | 2.3 | 2.9 | 0 | | 3 | 36.3 | 63.7 | 0 | | 0 | | 0 | | 0 |
| Comparative Example | 10 | 36.01 | 0.022 | 0.36 | 0.0005 | 0.0012 | 0.0015 | — | — | 20 | 23.4 | 20.5 | 10.2 | 23.8 | 22.1 | 0 | | 0 | | | 0 | | 0 | | 0 | | 5 |
| | 11 | 36.02 | 0.0005 | 0.45 | 0.0001 | 0.0001 | 0.0001 | — | — | 20 | 80.6 | 16.5 | 0.2 | 2.1 | 0.6 | 0 | | 0 | | | 0 | | 0 | | 0 | | 2 |
| | 12 | 35.98 | 0.033 | 0.32 | 0.0012 | 0.0023 | 0.0005 | — | — | 0 | | | | | | 0 | | 0 | | | 0 | | 20 | 100 | 0 | | 15 |
| | 13 | 36.02 | 0.011 | 0.35 | 0.0005 | 0.0005 | 0.0035 | 0.18 | — | 20 | 0.5 | 45.2 | 1.5 | 2.5 | 50.3 | 0 | | 0 | | | 0 | | 0 | | 0 | | 13 |
| | 14 | 36.05 | 0.356 | 0.38 | 0.0012 | 0.0004 | 0.0007 | — | — | 15 | 25.5 | 41.2 | 28.1 | 3.2 | 2 | 0 | | 5 | 42.1 | 57.9 | 0 | | 0 | | 0 | | *0 |
| | 15 | 36.04 | 0.022 | 0.32 | 0.0045 | 0.0012 | 0.0004 | — | — | 0 | | | | | | 0 | | 2 | 25.2 | 74.8 | 0 | | 4 | 100 | 14 | 100 | **4 |
| | 16 | 36.00 | 0.021 | 0.005 | 0.0012 | 0.0008 | 0.0008 | — | — | 18 | 0.2 | 43.4 | 10.2 | 23.5 | 22.7 | 0 | | 2 | 23.4 | 76.6 | 0 | | 0 | | 0 | | 5 |

*high thermal expansion coefficient
**bad surface quality

INDUSTRIAL APPLICABILITY

As mentioned above, by controlling the composition of inclusion included in the alloy material according to the invention to one or more of MnO—SiO2—Al2O3 system, SiO2 and MgO—Al2O3 is stabilized the inclusion against the etching solution, whereby there can be obtained Fe-36% Ni alloy based material for shadow mask having a good hole shape. Moreover, the invention can be used as a magnetic material or an electric material such as lead frame, bimetal or the like.

The invention claimed is:

1. A Fe—Ni alloy material for a shadow mask having an excellent etching workability, wherein the alloy material comprises, in % by weight:

Ni from 26 to 37
Si from 0.001 to 0.2
Mn from 0.01 to 0.6
Al from 0.0001 to 0.003
Mg not more than 0.001
Ca not more than 0.001, remainder Fe and inevitable impurities, the alloy material comprising at least two of the following inclusions (a) to (c) which are insoluble in an aqueous ferric chloride solution:

(a) MnO—$SiO_2$—$Al_2O_3$ comprising, by weight, from 25% to 50% of MnO, from 40% to 60% of $SiO_2$ and from 5% to 30% of $Al_2O_3$, and wherein (CaO+MgO) ≦30% by weight;

(b) MgO—$Al_2O_3$ spinel comprising, by weight, from 5% to 45% of MgO and from 55% to 95% of $Al_2O_3$;

(c) $SiO_2$.

2. The alloy material of claim 1, wherein the alloy material comprises inclusions (a) and (b).

3. The alloy material of claim 1, wherein the alloy material comprises inclusions (a) and (c).

4. The alloy material of claim 1, wherein the alloy material comprises inclusions (b) and (c).

5. The alloy material of claim 1, wherein the alloy material comprises inclusions (a), (b) and (c).

6. A Fe—Ni alloy material for a shadow mask having an excellent etching workability, wherein the alloy material comprises, in % by weight:

Ni from 26 to 37
Si from 0.001 to 0.2
Mn from 0.01 to 0.6
Al from 0.0001 to 0.003
Mg not more than 0.001
Ca not more than 0.001
Nb from 0.01 to 1.0, remainder Fe and inevitable impurities, the alloy material comprising at least two of the following inclusions (a) to (c) which are insoluble in an aqueous ferric chloride solution:

(a) MnO—$SiO_2$—$Al_2O_3$ comprising, by weight, from 25% to 50% of MnO, from 40% to 60% of $SiO_2$ and from 5% to 30% of $Al_2O_3$, and wherein (CaO+MgO) ≦30% by weight;

(b) MgO—$Al_2O_3$ spinel comprising, by weight, from 5% to 45% of MgO and from 55% to 95% of $Al_2O_3$;

(c) $SiO_2$.

7. The alloy material of claim 6, wherein the alloy material comprises inclusions (a) and (b).

8. The alloy material of claim 6, wherein the alloy material comprises inclusions (a) and (c).

9. The alloy material of claim 6, wherein the alloy material comprises inclusions (b) and (c).

10. The alloy material of claim 6, wherein the alloy material comprises inclusions (a), (b) and (c).

11. A Fe—Ni alloy material for a shadow mask having an excellent etching workability, wherein the alloy material comprises, in % by weight:

Ni from 26 to 37
Si from 0.001 to 0.2
Mn from 0.01 to 0.6
Al from 0.0001 to 0.003
Mg not more than 0.001
Ca not more than 0.001
Co from 1 to 8, remainder Fe and inevitable impurities, the alloy material comprising at least two of the following inclusions (a) to (c) which are insoluble in an aqueous ferric chloride solution:

(a) MnO—$SiO_2$—$Al_2O_3$ comprising, by weight, from 25% to 50% of MnO, from 40% to 60% of $SiO_2$ and from 5% to 30% of $Al_2O_3$, and wherein (CaO+MgO) ≦30% by weight;

(b) MgO—$Al_2O_3$ spinel comprising, by weight, from 5% to 45% of MgO and from 55% to 95% of $Al_2O_3$;

(c) $SiO_2$.

12. The alloy material of claim 11, wherein the alloy material comprises inclusions (a) and (b).

13. The alloy material of claim 11, wherein the alloy material comprises inclusions (a) and (c).

14. The alloy material of claim 11, wherein the alloy material comprises inclusions (b) and (c).

15. The alloy material of claim 11, wherein the alloy material comprises inclusions (a), (b) and (c).

16. A Fe—Ni alloy material for a shadow mask having an excellent etching workability, wherein the alloy material comprises, in % by weight:

Ni from 26 to 37
Si from 0.001 to 0.2
Mn from 0.01 to 0.6
Al from 0.0001 to 0.003
Mg not more than 0.001
Ca not more than 0.001
Nb from 0.01 to 1.0
Co from 1 to 8, remainder Fe and inevitable impurities, the alloy material comprising at least two of the following inclusions (a) to (c) which are insoluble in an aqueous ferric chloride solution:

(a) MnO—$SiO_2$—$Al_2O_3$ comprising, by weight, from 25% to 50% of MnO, from 40% to 60% of $SiO_2$ and from 5% to 30% of $Al_2O_3$, and wherein (CaO+MgO) ≦30% by weight;

(b) MgO—$Al_2O_3$ spinel comprising, by weight, from 5% to 45% of MgO and from 55% to 95% of $Al_2O_3$;

(c) $SiO_2$.

17. The alloy material of claim 16, wherein the alloy material comprises inclusions (a) and (b).

18. The alloy material of claim 16, wherein the alloy material comprises inclusions (a) and (c).

19. The alloy material of claim 16, wherein the alloy material comprises inclusions (b) and (c).

20. The alloy material of claim 16, wherein the alloy material comprises inclusions (a), (b) and (c).

* * * * *

UNITED STATES PATENT AND TRADEMARK OFFICE

CERTIFICATE OF CORRECTION

PATENT NO. : 7,014,721 B2
APPLICATION NO. : 10/399549
DATED : March 21, 2006
INVENTOR(S) : N. Shiga et al.

It is certified that error appears in the above-identified patent and that said Letters Patent is hereby corrected as shown below:

On Title Page (item 56)

On the cover of the printed patent, the following Foreign Application Priority Data was omitted and should be included:

--November 21, 2000 (JP) 2000-354375--

Signed and Sealed this

Twenty-seventh Day of March, 2007

JON W. DUDAS
*Director of the United States Patent and Trademark Office*